US005617704A

United States Patent [19]

Stauber

[11] Patent Number: 5,617,704

[45] Date of Patent: Apr. 8, 1997

[54] METHOD OF FORMING A TUBULAR PACK OF PRINTED PRODUCTS WITH A TRANSPARENT FOIL COVER

[75] Inventor: Hans-Ulrich Stauber, Grüt, Switzerland

[73] Assignee: Ferag AG, Hinwil, Switzerland

[21] Appl. No.: 546,214

[22] Filed: Oct. 20, 1995

Related U.S. Application Data

[63] Continuation-in-part of Ser. No. 100,976, Aug. 3, 1993, abandoned.

[30] Foreign Application Priority Data

Sep. 15, 1992 [CH] Switzerland ..... 02899/92

[51] Int. Cl.[6] ..... B65B 63/04

[52] U.S. Cl. ..... 53/430; 53/411; 53/412; 206/410; 206/459.5

[58] Field of Search ..... 242/528; 229/87.05; 206/410, 459.5; 53/118, 119, 131.2, 131.5, 131.1, 133.3, 133.8, 411, 412, 430

[56] References Cited

U.S. PATENT DOCUMENTS

| | | | |
|---|---|---|---|
| 2,082,114 | 6/1937 | Littlefield . | |
| 2,325,145 | 7/1943 | Martin | 53/412 |
| 2,615,290 | 10/1952 | Dyken . | |
| 2,691,856 | 10/1954 | Jensen et al. . | |
| 2,897,087 | 7/1959 | Lawlor . | |
| 2,967,383 | 1/1961 | Rumsey . | |
| 3,013,367 | 12/1961 | Sarre | 53/118 X |
| 3,247,956 | 4/1966 | Rosen | 206/389 X |
| 3,306,437 | 2/1967 | Nelson | 206/459.5 |
| 3,373,926 | 3/1968 | Voigtman et al. . | |
| 3,422,265 | 1/1969 | Bolasny | 206/459.5 X |
| 3,537,578 | 11/1970 | Figliuzzi | 206/459.5 X |
| 3,566,752 | 3/1971 | Dreher . | |
| 3,593,483 | 7/1971 | Tracy . | |
| 3,832,213 | 8/1974 | Brenner | 53/118 X |
| 4,056,918 | 11/1977 | Matsumoto . | |
| 4,195,787 | 4/1980 | Thomason | 206/459.5 X |
| 4,203,270 | 5/1980 | Forman . | |
| 4,676,047 | 6/1987 | Mutoh . | |
| 4,688,368 | 8/1987 | Honegger . | |
| 4,811,548 | 3/1989 | Reist . | |
| 4,826,551 | 5/1989 | Ingram | 53/412 X |
| 4,832,273 | 5/1989 | Honegger . | |
| 4,848,059 | 7/1989 | Muller et al. | 53/133.8 |
| 4,872,301 | 10/1989 | Langen et al. . | |
| 4,909,015 | 3/1990 | Leu . | |
| 5,129,518 | 7/1992 | Tanaka et al. | 229/87.05 X |

FOREIGN PATENT DOCUMENTS

| | | |
|---|---|---|
| 0313781 | 5/1989 | European Pat. Off. . |
| 2.118.613 | 7/1972 | France . |
| 2404564 | 4/1979 | France . |
| 2363761 | 6/1975 | Germany . |
| 2-127257 | 5/1990 | Japan . |
| 658727 | 10/1951 | United Kingdom . |
| 849400 | 9/1960 | United Kingdom . |
| 2075457 | 11/1981 | United Kingdom . |
| 2126188 | 3/1984 | United Kingdom . |

*Primary Examiner*—Daniel Moon
*Attorney, Agent, or Firm*—Walter C. Farley

[57] ABSTRACT

Tubular packs (P) containing a wound scaled formation of printed products and are held together by a protective/holding element (10) wound around the wound scaled formation. The protective/holding element is equipped with a feature to facilitate opening and for identification. The element is produced by guiding the protective/holding element (10), before or during winding, past at least one coating device which is moveable transversely to the conveying direction and coating the protective/holding element locally. At least one strip (20) is formed on the protective/holding elements (10) running from one transverse edge (12.1) to the other (12.2) and having a varying distance from the longitudinal edges (13) and therefore showing a discontinuity (14) in an overlap area of the transverse edge (12.2) on the outside of the pack. The discontinuity allows the edge to be easily recognizable. The coating additionally can weaken or prevent adhesion between overlapping surfaces of the protective/holding element (10), providing a physical help for opening the pack. Identification is aided by the strip (20) having, in different packs, different colors and/or different widths.

3 Claims, 2 Drawing Sheets

METHOD OF FORMING A TUBULAR PACK OF PRINTED PRODUCTS WITH A TRANSPARENT FOIL COVER

CROSS-REFERENCE TO RELATED APPLICATION

This is a continuation-in-part of Ser. No. 08/100,976 filed Aug. 3, 1993 and now abandoned.

FIELD OF THE INVENTION

This invention is in the field of post-printing processing of printed products and relates to a method and an apparatus for producing tubular packs which contain a wound scale formation of printed products which are held together by a protective/holding element.

BACKGROUND OF THE INVENTION

According to the prior art, printed products, especially newspapers and magazines, are wound or rolled up as a scale formation into tubular packs for transportation purposes. During the same winding process the packs are normally wrapped with a protective/holding element in the form of a paper sheet or a piece of plastic sheeting. The protective/holding element is dimensioned such that it is longer than the perimeter of the pack so that its two ends thus overlap. These two overlapping areas adhere together, typically by means of an adhesive, by welding or, when using self-adhesive plastic sheeting for the protective/holding element, as a result of the corresponding characteristics of the plastic surfaces.

Methods and apparatus for the production of such packs are described in such publications as U.S. Pat. No. 4,811,548 and U.S. Pat. No. 5,419,098 by the same applicant. According to these methods it is in particular possible to produce packs with variable diameters, the protective/holding element also having a variable length, in such a way that the overlap area is always the same independently of the pack diameter.

In order to individualize (individually separate) the printed products from the tubular pack, the protective/holding element is either removed and the scale formation of printed products is pushed together to form a stack, or the products are removed individually in an axial direction starting from the center of the pack, the protective/holding element theoretically keeping the pack together until the last product has been removed.

Printed products were in the past, and are still today, packed into packs containing the products in stacked form. These stack-packs are tied up and normally contain additional packaging material for protection. Such stack-packs further comprise, for distinguishability, printed identifications on the packaging material or simply on a sheet lying on the surface of the stack e.g. a receiver's address. In order to be able to identify these packs as e.g. containing a specific type of printed products, the packs are usually tied up with cords or tapes of different colors and thus an easily visible means of identification is created, which means hardly influences the production.

The advantages of the tubular packs compared with the stackpacks are numerous. In the tubular packs all printed products are oriented in the same direction whereas in stack-packs e.g. folded products must be stacked crosswise. Tubular packs have a stability which is less dependant on the nature and amount of products than the stability of stackpacks. Tubular packs do not require tying up as a suitably chosen protective/holding element can easily withstand the radial forces which act on this element by the rolled printed products. Tying up is still possible, but it would lengthen the pack production unnecessarily and thus make it more expensive. However, with no tying there is no possibility of pack identification by differing tying means. A further disadvantage of tubular packs wrapped in a protective/holding element, especially of packs opened by removing the protective/holding element, is the fact that it is not always easy to detect the region of overlap of the protective/holding element and to open it. This disadvantage is particularly important when a transparent adhesive plastic sheeting material is used for the protective/holding element.

SUMMARY OF THE INVENTION

For these reasons, it is an object of the invention to create a method and an apparatus for producing packs containing a plurality of wound printed products in scale formation and held together by a protective/holding element, the packs additionally not only comprising an at least optical aid for opening the protective/holding element but also a simple means of identification easily visible from a distance. Hereby the method and the apparatus for producing the pack with means for facilitating opening and for identification is only to differ slightly from the production of comparable known packs, especially the time required for producing the pack is not to be increased and the method is to be carried out with only minimal additional expenditures regarding apparatus and material.

BRIEF DESCRIPTION OF THE DRAWINGS

The method according to the invention and the apparatus for carrying it out are described in detail with reference to the following figures wherein.

DESCRIPTION OF THE PREFERRED EMBODIMENT

Figure 1:
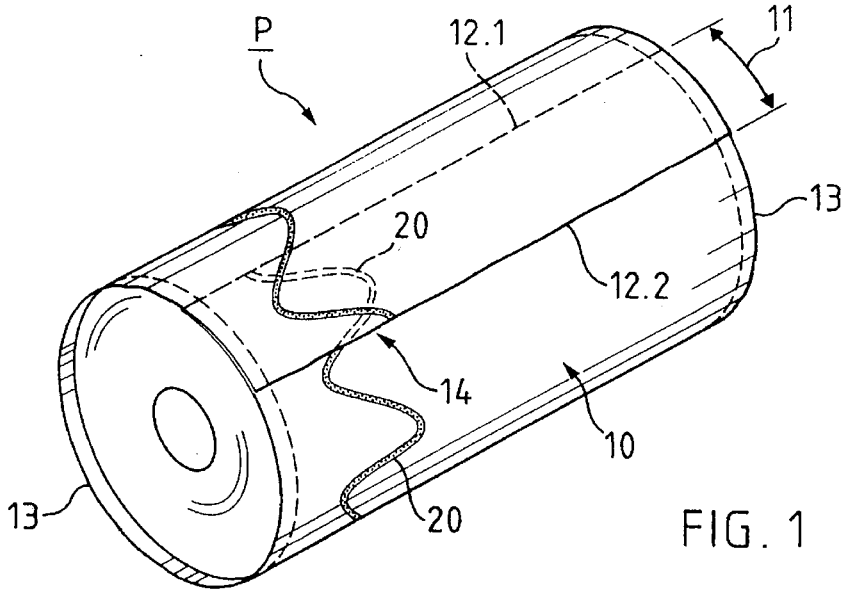
FIG. 1 is a perspective view of an embodiment of a tubular pack with protective/holding element and with means for facilitating opening and for identification, according to the invention.

FIG. 1 shows a tubular pack indicated generally at P which contains a wound scale or imbricated formation of printed products. The pack is held together by a protective/holding element 10 which may be wider or narrower than the wound printed products or have the same width as the products. The protective/holding element is longer than the circumference of pack P such that its ends overlap in an overlap region 11. The main object of the protective/holding element 10 is to hold together the pack. Apart from this, especially when it covers a large part of the surface of the pack, it can have a protecting function in order to protect the printed products from external influences.

Figure 2:
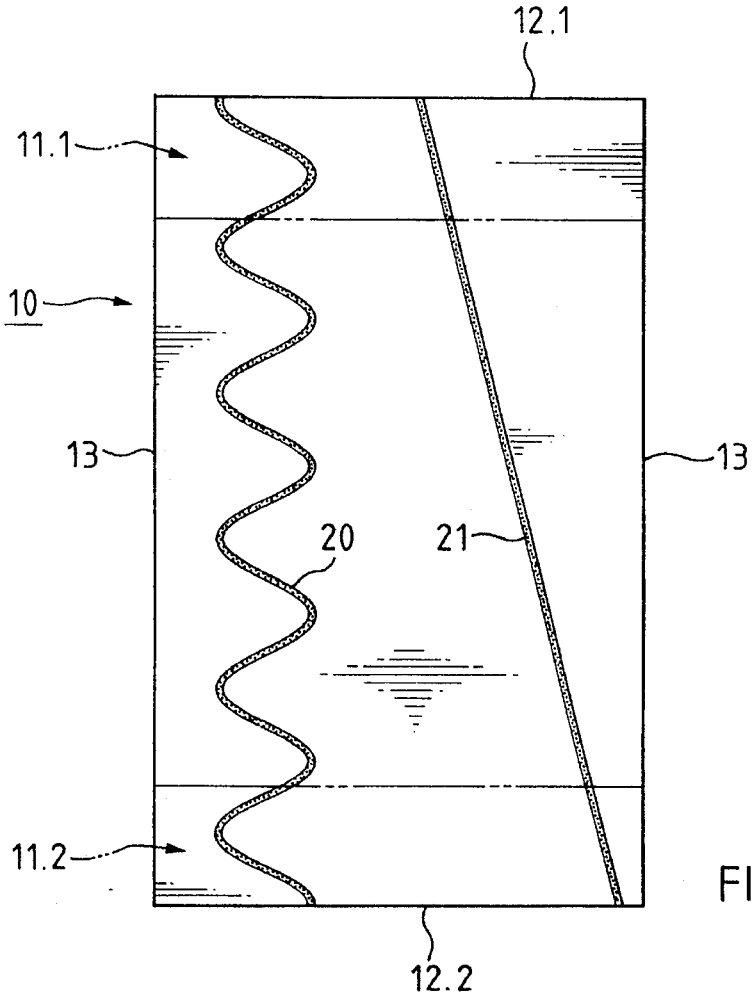
FIG. 2 is an opened-out plan view of a protective/holding element of a pack produced according to the invention.

FIG. 2 shows the protective/holding element 10 lying flat and positioned such that its edges 12.1 and 12.2 (transverse edges) which will extend in an axial direction on the pack are horizontal and the edges 13 (longitudinal edges) running substantially round the perimeter of the pack are vertical. The inner limits of two ends 11.1 and 11.2 of the protective/holding element which will overlap and form region 11 on the finally formed pack are indicated with broken lines.

The protective/holding element 10 preferably comprises a self-adhesive plastic sheeting whose surfaces when pressed together lightly adhere to each other sufficiently to hold the pack together. Such adhesive sheets are normally transparent. The protective/holding element 10 can, however, alternatively comprise a strong paper, the ends of which are glued together in the overlap area, or it can comprise another suitable material which has sufficient mechanical strength and has surfaces which can be fastened together easily and with sufficient stability.

Pack P produced according to the invention, or the protective/holding element 10 of this pack, differ from known packs in the means for facilitating opening and for identification, which means, as can be seen in FIGS. 1 and 2, are in the form of at least one strip substantially continuously extending over the whole length of the protective holding element, i.e. from its one transverse edge 12.1 to its other transverse edge 12.2. In accordance with the invention, the at least one strip 20 or 21 does not extend in parallel with the longitudinal edges 13 but has a varying distance from these edges, e.g. a cyclically or continuously varying distance. Strip 20 of the pack shown in FIG. 1 is sinusoidal. The protective/holding element of FIG. 2 is shown as two strips 20 and 21, strip 20 corresponding to strip 20 of FIG. 1 and the other strip 21 running as a substantially straight line at an angle to the longitudinal edges 13.

The at least one strip 20, 21 running along the length of the protective/holding element fulfills its function of facilitating opening of the pack by the fact that it shows a discontinuity 14 in the area of transverse edge 12.2 on the outside of the pack by which discontinuity this edge can easily be recognized. If the protective/holding element is transparent, a discontinuity in the area of the inside transverse edge 12.1 is also visible as well as the double course of the strip in the overlap area 11, which double course is easily recognizable as a strip 20 with a cyclically alternating distance from the longitudinal edges 13 by the 'phase displacement' as seen in FIG. 1 in the overlap region.

If the strip further comprises a material which weakens the adhesion between the surfaces of the protective/holding element 10 or even prevents this adhesion, a local interruption or weak point in the adhesion between the two end areas is formed in the area of the outside transverse edge 12.2 of the protective/holding element where strip 20 runs into the overlap 11 between the two end areas 11.1 and 11.2 of the protective/holding element. This interruption or weak point can serve as a physical means to facilitate the opening of the pack.

The at least one strip 20, 21 fulfills the function of identification in that it can have different colors, different widths (extending parallel to the transverse edges), different courses (e.g. different wave lengths and/or different amplitude when running sinusoidally, e.g. a different gradient when running in a straight line) and/or can have different axial positions. Furthermore, two or more such strips can be applied to a pack, as illustrated in FIG. 2.

Figure 3:
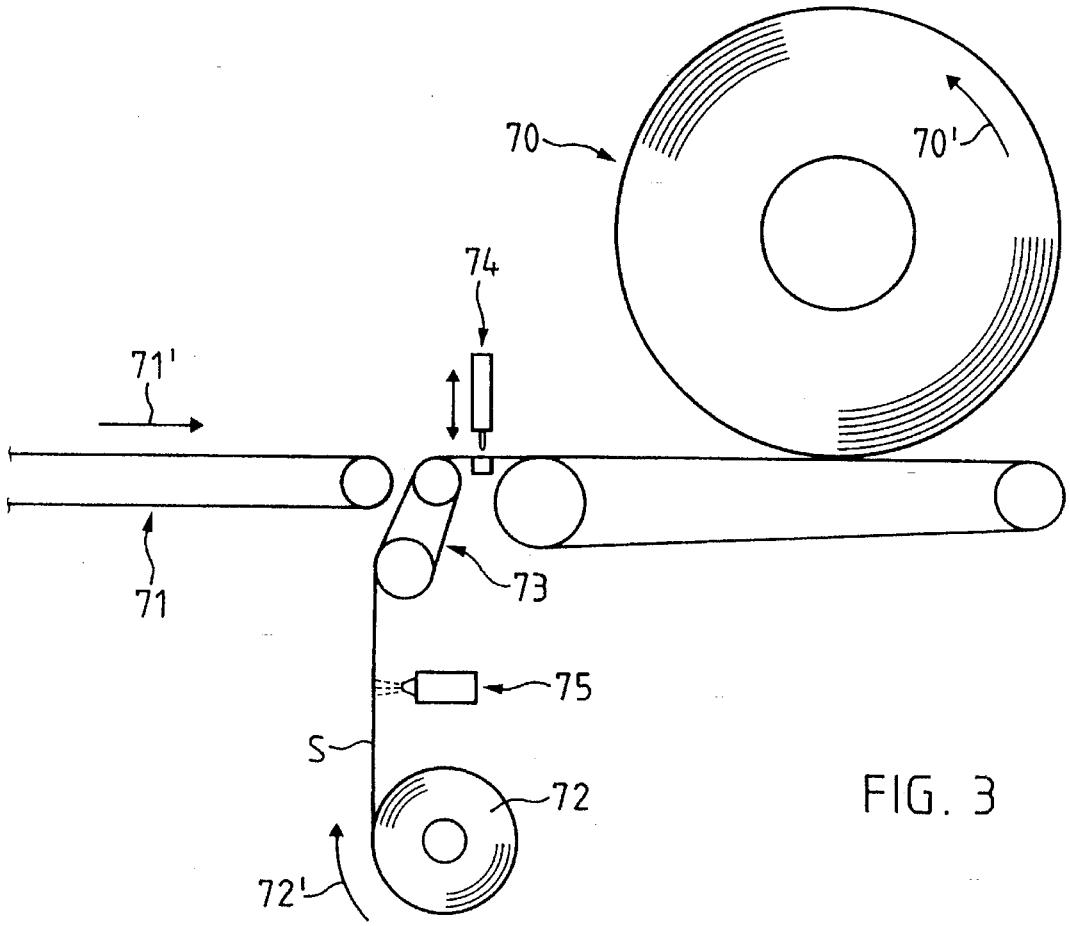
FIG. 3 is a schematic side elevation of an apparatus for carrying out the method according to the invention, i.e. for producing packs as shown in FIG. 1.

FIG. 3 very schematically shows an embodiment of an apparatus with which tubular packs according to FIG. 1 are produced. This apparatus comprises the following substantially known devices: a winding device 70 having a direction of winding 70', and a conveying device 71 having a conveying direction 71' for conveying and winding the scaled formation of printed products; a supply roll 72 with a direction of winding 72' and a cooperating conveying means 73 for supplying a quasi-endless web of material S for forming the protective/holding element; a cutting means 74 for cutting lengths of material for forming protective/holding elements from material S; and at least one coating device 75 for application of the at least one strip (20, 21) to the material S or the protective/holding elements, respectively, which coating device is passed by material S or by the protective/holding elements for local coating.

The at least one coating device 75 is arranged at a convenient point between supply roll 72 and winding device 70 and e.g. comprises a spray nozzle by which the material S is locally coated, with e.g. a liquid and fast-drying coating material, over a width which is small compared to the total width of material S. The coating device is arranged such that it is movable in a controlled manner in a direction substantially transverse to the movement of material S or to the protective/holding elements respectively, i.e. substantially transverse to the longitudinal edges of the protective/holding elements (in FIG. 3 transverse to the plane of the paper) such that the position of the coating can be changed over the width of material S.

Figure 4:
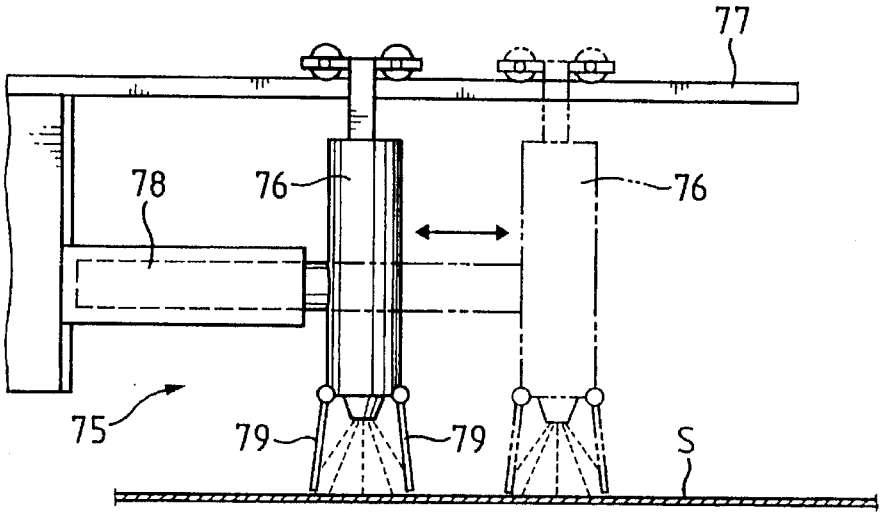
FIG. 4 is a side elevation of a coating device for an apparatus according to the invention for producing tubular packs of printed products.

FIG. 4 very schematically shows a coating device 75, the view of FIG. 4 being in the direction of movement of material S or the protective/holding elements respectively (parallel to its longitudinal edges). The coating device comprises a spray nozzle 76 which is guided by a rail 77 running transverse to the longitudinal edges of material S over its width and which is movably driven by a linear drive 78. The spray nozzle is shown in two positions (with broken and unbroken lines). The spray nozzle may comprise lateral limit stops 79 which may be adjustable for adjusting the width of the coated strip. Alternatively, the width of strip can be adjusted via the distance between the spraying nozzle and the material S or the protective/holding element, respectively.

For carrying out the method according to the invention, winding device 70 and conveying device 71 are controlled in a coordinated manner such that a limited scale formation is wound and then at least the winding movement is stopped and the pack is ejected. The conveying means 73 for the material S, the cutting means 74 and the coating device 75 are controlled in coordination with the winding process such that towards the end of the winding process material S is fed into the winding process with a forward transverse edge and wound with the end of the scaled formation, such that a protective/holding element corresponding to the perimeter of the pack to be produced is cut off material S (backward transverse edge), and such that the supply of material S is then stopped and the coating device 75 is substantially switched to be active as long as the conveying means device 73 is active and switched not to be active (passive) whenever no material S is supplied.

The movement of the at least one coating device 75, which movement is substantially transverse to the supply direction of material S, can be, as mentioned above, a simple oscillation with e.g. adjustable amplitude and frequency or a superposition of various such oscillations which also results in a cyclic movement and therefore a course of strip with a cyclically changing distance from the longitudinal edges of the protective/holding element. Such a movement is controlled such that it is permanently executed or such that it is stopped as long as the coating device is not active.

Furthermore, the control of the transverse movement of the coating device can be coordinated with the active/passive switching of the coating device, e.g. such that the coating device is moved with a substantially constant speed (strip 21 of FIG. 2) from a starting position in one direction when active and is moved back to the starting position when passive.

Advantageously, different coating devices 75 are used for different colors of strip, which coating devices can be chosen to be used selectively. Advantageously, the coating is applied to the outside of the protective/holding element, as shown in FIG. 3, preventing adherence of the coating to the printed products which might cause damage. It can also be advantageous to install a drying device following (downstream of) the at least one coating device so that the applied coating does not do damage when it comes into contact with the conveying means or the printed products or with other surface areas of the protective/holding element.

A variation of the method and the apparatus, as described in connection with FIGS. 3 and 4, includes arranging the at least one coating device such that, instead of the quasi-endless material S, the cut off protective/holding element is coated before or while being wound onto the printed products. This arrangement, however, requires a considerably more accurate active/passive switching for the coating device. The active/passive switching of the at least one coating device can also be arranged such that the strip does not start precisely on the forward transverse edge (transverse edge on the inside of the pack) of the protective holding element. However, in order to make the outside edge visible (discontinuity of the strip), it is necessary for the strip to begin inside the overlap area.

A further variation is that the protective/holding element is not produced by cutting it off of a quasi-endless material during the winding process but that it is fed into the winding process as a separate item, e.g. from a stack.

The individual devices and means of the apparatus according to FIGS. 3 and 4 and those of variants thereof are all known per se and can be arranged and controlled with the help of the above description for carrying out the method according to the invention by one skilled in the art. Therefore a detailed description of these devices is omitted here.

When producing packs with a constant diameter, occurrence of a discontinuity (14 in FIG. 1) or phase displacement of a strip with cyclically varying distance from the longitudinal edges of the protective/holding element is enforced by corresponding choice of the length of cycle (wave length). When producing packs with varying diameter and therefore varying length of the protective/holding elements a choice must be made (e.g. a length of cycle as long as possible) such that discontinuity and phase displacement occur with a high probability. If the strip is linear, the discontinuity in the area of the overlap occurs in any case.

What is claimed is:

1. A method for producing a sequence of tubular packs each containing a wound scale formation with a head end and a tail end, each scale formation consisting of a freely selectable number of a freely selectable kind of printed products, each pack being wrapped in a protective and holding foil, the method comprising the steps of:

delivering a first scale formation having a head end downstream toward a winding mandrel, said mandrel having an axis of rotation, winding the scale formation onto the winding mandrel starting with the head end, providing a supply roll of a web of transparent, self-adhesive foil for delivery to the scale formation to form a wrapper around the wound scale formation, positioning a head end of the web on a surface of the supplied scale formation facing away from the mandrel during winding of the scale formation and moving the head end with the scale formation, delivering and positioning the foil such that the head end of the foil is downstream of the tail end of the scale formation and such that the foil extends upstream beyond the tail end of the scale formation, cutting the foil from the supply roll at a location along the foil spaced from the tail end of the scale formation and stopping the delivery of foil, positioning a coating device between the supply roll and the winding mandrel so that the coating device is laterally movable relative to the foil and generally parallel with the axis of rotation of the mandrel, with the coating device and as the foil is being delivered to the scale formation, coating the foil to form on the foil a substantially continuous, non-linear strip extending along the foil at a varying distance from a longitudinal edge of the foil, the strip having a width significantly smaller than the width of the foil, and stopping the coating when delivery of web material is stopped, stopping the winding mandrel when the foil cut from the supply roll is fully wound around the wound scale formation to form a wrapper, ejecting the wound and wrapped pack from the mandrel while delivery of the web is stopped and the coating device is inactive, while the coating device is inactive, selecting coating strip width, lateral strip position, and amplitude and frequency of coating device lateral movement parameters for the coating device in accordance with characteristics of a next scale formation to be wound into a pack, and repeating the foregoing steps for each pack to be produced.

2. A method according to claim 1 wherein the strip is applied to a surface of the web material facing the outside of the pack being formed.

3. A method according to claim 1 wherein self-adhesion of the plastic surfaces is weakened or prevented by the coating.

* * * * *